US008922464B2

(12) United States Patent
Inoue et al.

(10) Patent No.: US 8,922,464 B2
(45) Date of Patent: Dec. 30, 2014

(54) ACTIVE MATRIX DISPLAY DEVICE AND DRIVING METHOD THEREOF

(75) Inventors: Seiko Inoue, Kanagawa (JP); Hiroyuki Miyake, Kanagawa (JP); Jun Koyama, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 90 days.

(21) Appl. No.: 13/465,238

(22) Filed: May 7, 2012

(65) Prior Publication Data

US 2012/0287025 A1 Nov. 15, 2012

(30) Foreign Application Priority Data

May 11, 2011 (JP) ..... 2011-105909

(51) Int. Cl.
*G09G 3/30* (2006.01)
*G09G 3/32* (2006.01)

(52) U.S. Cl.
CPC ..... *G09G 3/3233* (2013.01); *G09G 2300/0861* (2013.01)
USPC ..... 345/76

(58) Field of Classification Search
None
See application file for complete search history.

(56) References Cited

U.S. PATENT DOCUMENTS 5,684,365 A 11/1997 Tang et al.
5,956,011 A 9/1999 Koyama et al.
6,037,924 A 3/2000 Koyama et al.
6,229,506 B1 5/2001 Dawson et al.
6,310,598 B1 10/2001 Koyama et al.
6,362,798 B1 3/2002 Kimura et al.
6,518,945 B1 2/2003 Pinkham
6,577,302 B2 6/2003 Hunter et al.
6,608,613 B2 8/2003 Koyama et al.
6,611,130 B2 8/2003 Chang
6,709,901 B1 3/2004 Yamazaki et al.
6,768,348 B2 7/2004 Shionoiri et al.
6,858,989 B2 2/2005 Howard
7,042,162 B2 5/2006 Yamazaki et al.

(Continued)

FOREIGN PATENT DOCUMENTS

CN 1799081 A 7/2006
EP 0 717 446 A2 6/1996

(Continued)

OTHER PUBLICATIONS

J.H. Jung et al.; "49.1 : A 14.1 inch Full Color AMOLED Display with Top Emission Structure and a-Si TFT Backplane"; SID Digest '05 : SID International Symposium Digest of Technical Papers; 2005; pp. 1538-1541; vol. 36.

(Continued)

*Primary Examiner* — William Boddie
*Assistant Examiner* — Bipin Gyawali
(74) *Attorney, Agent, or Firm* — Fish & Richardson P.C.

(57) ABSTRACT

In a circuit in FIG. 1, pluses are input to a first gate signal line and a second gate signal line in accordance with a timing chart in FIG. 3, so that transistors in the circuit are turned on/off. As a result, a potential difference between a third node and a second node does not depend on the threshold voltage of a fourth transistor and is determined only by a potential of a data line and a potential of a second wiring. Therefore, an intended current can flow in a display element.

19 Claims, 8 Drawing Sheets

(56) References Cited

U.S. PATENT DOCUMENTS

| | | | | |
|---|---|---|---|---|
| 7,068,246 | B2 | 6/2006 | Yamazaki et al. | |
| 7,091,750 | B2 | 8/2006 | Shionoiri et al. | |
| 7,129,917 | B2 | 10/2006 | Yamazaki et al. | |
| 7,317,429 | B2 | 1/2008 | Shirasaki et al. | |
| 7,327,168 | B2 | 2/2008 | Kimura | |
| 7,362,289 | B2 | 4/2008 | Yamazaki et al. | |
| 7,365,713 | B2 | 4/2008 | Kimura | |
| 7,429,985 | B2 | 9/2008 | Kimura et al. | |
| 7,456,810 | B2 | 11/2008 | Kimura | |
| 7,515,121 | B2 | 4/2009 | Sato et al. | |
| 7,518,580 | B2 | 4/2009 | Kwon | |
| 7,528,643 | B2 | 5/2009 | Kimura | |
| 7,671,826 | B2 | 3/2010 | Kimura | |
| 7,674,650 | B2 | 3/2010 | Akimoto et al. | |
| 7,679,585 | B2 | 3/2010 | Kimura | |
| 7,679,587 | B2 | 3/2010 | Kwak | |
| 7,710,368 | B2 | 5/2010 | Chung | |
| 7,714,813 | B2 | 5/2010 | Uchino et al. | |
| 7,800,565 | B2 | 9/2010 | Nathan et al. | |
| 7,817,117 | B2 | 10/2010 | Kimura | |
| 7,924,244 | B2 | 4/2011 | Kimura et al. | |
| 7,965,106 | B2 | 6/2011 | Kimura | |
| 7,982,696 | B2 | 7/2011 | Kimura | |
| 8,004,477 | B2 | 8/2011 | Uchino et al. | |
| 8,059,068 | B2 | 11/2011 | Kimura | |
| 8,063,859 | B2 | 11/2011 | Kimura | |
| 2001/0043168 | A1 | 11/2001 | Koyama et al. | |
| 2003/0090481 | A1 | 5/2003 | Kimura | |
| 2003/0095087 | A1 | 5/2003 | Libsch et al. | |
| 2003/0103022 | A1 | 6/2003 | Noguchi et al. | |
| 2003/0112208 | A1 | 6/2003 | Okabe et al. | |
| 2003/0117352 | A1 | 6/2003 | Kimura | |
| 2003/0132931 | A1* | 7/2003 | Kimura et al. | 345/212 |
| 2003/0137503 | A1 | 7/2003 | Kimura et al. | |
| 2004/0070557 | A1 | 4/2004 | Asano et al. | |
| 2004/0080474 | A1 | 4/2004 | Kimura | |
| 2004/0174349 | A1 | 9/2004 | Libsch et al. | |
| 2004/0174354 | A1 | 9/2004 | Ono et al. | |
| 2004/0207614 | A1 | 10/2004 | Yamashita et al. | |
| 2005/0057459 | A1 | 3/2005 | Miyazawa | |
| 2005/0083270 | A1 | 4/2005 | Miyazawa | |
| 2005/0200618 | A1 | 9/2005 | Kim et al. | |
| 2005/0206593 | A1 | 9/2005 | Kwon | |
| 2005/0237273 | A1 | 10/2005 | Ozawa et al. | |
| 2005/0259051 | A1 | 11/2005 | Lee et al. | |
| 2005/0269959 | A1 | 12/2005 | Uchino et al. | |
| 2006/0066532 | A1 | 3/2006 | Jeong | |
| 2006/0156121 | A1 | 7/2006 | Chung | |
| 2006/0170628 | A1 | 8/2006 | Yamashita et al. | |
| 2006/0176250 | A1 | 8/2006 | Nathan et al. | |
| 2006/0208977 | A1 | 9/2006 | Kimura | |
| 2006/0221005 | A1 | 10/2006 | Omata et al. | |
| 2006/0238461 | A1 | 10/2006 | Goh et al. | |
| 2006/0255837 | A1 | 11/2006 | Shionoiri et al. | |
| 2006/0279499 | A1 | 12/2006 | Park et al. | |
| 2007/0002084 | A1 | 1/2007 | Kimura et al. | |
| 2007/0063993 | A1 | 3/2007 | Shishido | |
| 2007/0064469 | A1 | 3/2007 | Umezaki | |
| 2007/0085847 | A1 | 4/2007 | Shishido | |
| 2007/0103419 | A1 | 5/2007 | Uchino et al. | |
| 2007/0115225 | A1 | 5/2007 | Uchino et al. | |
| 2007/0120785 | A1 | 5/2007 | Kimura | |
| 2007/0120795 | A1 | 5/2007 | Uchino et al. | |
| 2007/0126664 | A1 | 6/2007 | Kimura | |
| 2007/0126665 | A1 | 6/2007 | Kimura | |
| 2007/0126668 | A1 | 6/2007 | Kimura | |
| 2007/0200793 | A1 | 8/2007 | Kwon | |
| 2007/0236424 | A1 | 10/2007 | Kimura | |
| 2007/0247398 | A1 | 10/2007 | Nathan et al. | |
| 2008/0225061 | A1 | 9/2008 | Kimura et al. | |
| 2008/0284312 | A1 | 11/2008 | Kimura | |
| 2009/0009676 | A1 | 1/2009 | Kimura et al. | |
| 2009/0021539 | A1 | 1/2009 | Kimura | |
| 2009/0051674 | A1 | 2/2009 | Kimura et al. | |
| 2009/0096727 | A1 | 4/2009 | Kimura | |
| 2009/0134920 | A1 | 5/2009 | Kimura | |
| 2009/0167404 | A1 | 7/2009 | Kimura | |
| 2010/0079357 | A1 | 4/2010 | Ozawa et al. | |
| 2010/0149160 | A1 | 6/2010 | Kimura | |
| 2010/0156877 | A1 | 6/2010 | Kimura | |
| 2010/0220117 | A1 | 9/2010 | Kimura | |
| 2011/0115758 | A1 | 5/2011 | Kimura et al. | |
| 2011/0115764 | A1* | 5/2011 | Chung | 345/205 |
| 2011/0163320 | A1 | 7/2011 | Kimura | |
| 2011/0164071 | A1* | 7/2011 | Chung et al. | 345/690 |
| 2011/0169008 | A1 | 7/2011 | Kimura | |
| 2011/0198599 | A1 | 8/2011 | Kimura | |
| 2011/0205144 | A1 | 8/2011 | Kimura et al. | |
| 2011/0205215 | A1 | 8/2011 | Kimura | |
| 2011/0210950 | A1 | 9/2011 | Kimura | |
| 2011/0227908 | A1* | 9/2011 | Choi | 345/215 |
| 2011/0248746 | A1 | 10/2011 | Kimura | |
| 2011/0260170 | A1 | 10/2011 | Kimura | |

FOREIGN PATENT DOCUMENTS

| | | | |
|---|---|---|---|
| EP | 1 632 930 | A1 | 3/2006 |
| JP | 08-234683 | A | 9/1996 |
| JP | 2003-195810 | A | 7/2003 |
| JP | 2004-280059 | A | 10/2004 |
| JP | 2004-295131 | A | 10/2004 |
| JP | 2005-189643 | A | 7/2005 |
| JP | 2006-215275 | A | 8/2006 |

OTHER PUBLICATIONS

European Search Report (European Patent Application No. 07020230.4) dated Aug. 3, 2010.

Chinese Office Action (Chinese Patent Application No. 200710167938.2) dated Aug. 25, 2010 (with English language translation).

Toshio Kamiya et al.; "Carrier Transport Properties and Electronic Structures of Amorphous Oxide Semiconductors: The present status"; Solid State Physics; Sep. 1, 2009; pp. 621-633; vol. 44, No. 9; Agne Gijutsu Center (with English language translation).

* cited by examiner

ACTIVE MATRIX DISPLAY DEVICE AND DRIVING METHOD THEREOF

BACKGROUND OF THE INVENTION

1. Field of the Invention

The present invention relates to an active matrix display device. In particular, the present invention relates to an active matrix display device including a display element having diode characteristics. The display element having diode characteristics includes, for example, an organic EL (electroluminescence) diode, a light emitting diode, and the like, but is not limited thereto. The display element having diode characteristics refers to the one which exhibits diode characteristics or characteristics close to diode characteristics in the voltage versus current characteristics and thus is changed in the amount of light emission, the transmittance, the reflectance, the color tone, the chroma, and the like to be changed in optical characteristics. Hereinafter, the display element having diode characteristics is also simply referred to as a display element.

2. Description of the Related Art

As a typical example of an electro-optical element having diode characteristics, an organic EL element is given. In addition, an active matrix organic EL display device is known in which organic EL elements are formed in a matrix over a substrate and the organic EL elements are controlled by respective transistors to display an image.

Amorphous silicon, polycrystalline silicon, an oxide semiconductor, or the like is used for a semiconductor layer of a transistor used in an active matrix organic EL display device for the necessity of formation on a large area at a limited temperature range (e.g., see Patent Documents 1 to 3).

In the case of such a transistor including the semiconductor material, variations in the threshold voltage are generally large. In an organic EL display device, the degree of light emission is controlled by the values of currents flowing in the organic EL elements, thereby obtaining a gray scale level. In an active matrix organic EL display device, the values of currents flowing in the organic EL elements are controlled by transistors, and the current value also depends on the threshold voltages of the transistors. Therefore, when the threshold voltage of the transistor is varied, the value of the current flowing in the organic EL element is also varied, so that display lacks uniformity.

In order to suppress a display defect caused by such the variations in the threshold voltage, a technique for correcting the threshold voltage with the use of a plurality of transistors is known (see Patent Documents 2 and 3). Patent Documents 2 and 3 disclose examples in which a threshold voltage correcting circuit is formed using only n-channel transistors, only p-channel transistors, or a combination of n-channel transistors and p-channel transistors.

REFERENCE

[Patent Document]
[Patent Document 1] U.S. Pat. No. 7,674,650
[Patent Document 2] U.S. Pat. No. 6,229,506
[Patent Document 3] U.S. Pat. No. 7,429,985

SUMMARY OF THE INVENTION

Depending on an applicable semiconductor material, a practical p-channel transistor cannot be obtained. Similarly, depending on an applicable semiconductor material, an n-channel transistor cannot be obtained. In addition, a transistor needs to be connected to a positive electrode in some cases from the point of view of a structure or a manufacturing method of the display element. Similarly, a transistor needs to be connected to a negative electrode of a display element in some cases.

For example, in the case where only an n-channel transistor can be used and the transistor needs to be connected to a positive electrode of a display element, a method disclosed in Patent Document 2 cannot be employed. In such a case, for example, it is necessary to use a circuit disclosed in FIGS. 39A to 39E of Patent Document 3.

The circuit disclosed in Patent Document 3 is illustrated in FIG. 2. FIG. 2 is a circuit needed for one dot (which is a minimum unit of a display device. In general, one pixel includes dots of a plurality of primary colors). This is the dot which includes nine wirings, i.e., a first gate signal line 201, a second gate signal line 202, a third gate signal line 203, a fourth gate signal line 204, a fifth gate signal line 205, a data line 206, a first wiring 207, a second wiring 208, and a third wiring 209 (which is formed over an element), and further includes a light-emitting element 210, a capacitor 211, and seven transistors, i.e., a first transistor 212, a second transistor 213, a third transistor 214, a fourth transistor 215, a fifth transistor 216, a sixth transistor 217, and a seventh transistor 218.

Needless to say, increase in the number of wirings and increase in the number of elements are not preferable because they cause reduction in the manufacturing yield. One object of one embodiment of the present invention is to provide a circuit configuration which is further simplified. Another object of one embodiment of the present invention is to provide a driving method of the circuit.

Note that the descriptions of these problems do not disturb the existence of other problems. Note that one embodiment of the present invention does not necessarily achieve all the objects listed above. Other objects will be apparent from and can be derived from the description of the specification, the drawings, the claims, and the like.

Structures which can solve the above problems are described below. Before the description of the structures, terms used in this specification are described. Note that in this specification and the like, a transistor is an element including at least three terminals, i.e., a gate, a drain, and a source. In addition, the transistor has a channel region between a drain (a drain terminal, a drain region, or a drain electrode) and a source (a source terminal, a source region, or a source electrode), and current can flow through the drain, the channel region, and the source.

Here, since the source and the drain of the transistor change depending on the structure, the operating condition, and the like of the transistor, it is difficult to define which is a source or a drain. Thus, a portion which functions as the source and a portion which functions as the drain are not called a source and a drain and one of the source and the drain is referred to as a first electrode and the other thereof is referred to as a second electrode in some cases.

Also in the case of an element having two terminals, such as a capacitor or a diode, one electrode is referred to a first electrode and the other electrode is referred to as a second electrode in some cases. In this case, even when a positive electrode and a negative electrode are distinguished from each other in the capacitor or the diode, "the first electrode" does not indicate whether the one electrode is the positive electrode or is the negative electrode. However, when it is necessary to specify the positive electrode and the negative electrode because of the characteristics of the circuit, description is additionally made in some cases.

Note that in this specification and the like, terms such as "first", "second", and "third" are used for distinguishing various elements, members, regions, layers, and areas from others. Therefore, the terms such as "first", "second", "third", and the like do not limit the number of the elements, members, regions, layers, areas, or the like. Further, for example, it is possible to replace "first" with "second", "third", or the like.

Note that in this specification and the like, when it is explicitly described that X and Y are connected, the case where X and Y are electrically connected, the case where X and Y are functionally connected, and the case where X and Y are directly connected are included therein. Here, each of X and Y denotes an object (e.g., a device, an element, a circuit, a wiring, an electrode, a terminal, a conductive film, a layer, or the like). Accordingly, another connection relation shown in drawings and texts is included without being limited to a predetermined connection relation, for example, the connection relation shown in the drawings and the texts.

For example, in the case where X and Y are electrically connected, one or more elements which enable electrical connection between X and Y (e.g., a switch, a transistor, a capacitor, an inductor, a resistor, and/or a diode) can be connected between X and Y.

Note that when it is explicitly described that X and Y are electrically connected, the case where X and Y are electrically connected (i.e., the case where X and Y are connected with another element or another circuit provided therebetween), the case where X and Y are functionally connected (i.e., the case where X and Y are functionally connected with another circuit provided therebetween), and the case where X and Y are directly connected (i.e., the case where X and Y are connected without another element or another circuit provided therebetween) are included therein. That is, when it is explicitly described that "X and Y are electrically connected", the description is the same as the case where it is explicitly only described that "X and Y are connected".

Note that in this specification and the like, it might be possible for those skilled in the art to constitute one embodiment of the invention even when portions to which all the terminals of an active element (e.g., a transistor), a passive element (e.g., a capacitor), or the like are connected are not specified. In particular, in the case where the number of portions to which the terminal is connected might be plural, it is not necessary to specify the portions to which the terminal is connected. Thus, it might be possible to constitute one embodiment of the invention by specifying only portions to which some of terminals of an active element, a passive element, or the like are connected.

Note that in this specification and the like, it might be possible for those skilled in the art to specify the invention when at least the connection portion of a circuit is specified. Alternatively, it might be possible for those skilled in the art to specify the invention when at least a function of a circuit is specified.

Therefore, when a connection portion of a circuit is specified, the circuit is disclosed as one embodiment of the invention even when a function is not specified, and one embodiment of the invention can be constituted. Alternatively, when a function of a circuit is specified, the circuit is disclosed as one embodiment of the invention even when a connection portion is not specified, and one embodiment of the invention can be constituted.

Note that in this specification and the like, explicit singular forms preferably mean singular forms. However, without being limited thereto, such singular forms can include plural forms. Similarly, explicit plural forms preferably mean plural forms. However, without being limited thereto, such plural forms can include singular forms.

Note that in this specification and the like, pixels might be provided (arranged) in matrix. Here, description that pixels are provided (arranged) in matrix includes the case where the pixels are arranged in a straight line and the case where the pixels are arranged in a jagged line, in a longitudinal direction or a lateral direction. Thus, for example, when full color display is performed with three color elements (e.g., R, G, and B), the following cases are included: the case where the pixels are arranged in stripes, the case where dots of the three color elements are arranged in a delta pattern, the case where the dots of the three color elements are provided in Bayer arrangement, the case where the dots of the three color elements are provided in a mosaic pattern. Further, the sizes of display regions may be different between respective dots of color elements. Thus, power consumption can be reduced and the life of a display element can be prolonged.

One embodiment of the present invention is an active matrix display device which includes a circuit. The circuit includes a first gate signal line, a second gate signal line, a data line, a first transistor, a second transistor, a third transistor, a fourth transistor, a fifth transistor, a sixth transistor, a capacitor, and a display element. A gate of the first transistor is connected to the first gate signal line, a first electrode of the first transistor is connected to the data line, and a second electrode of the first transistor is connected to a second electrode of the fourth transistor and a first electrode of the fifth transistor. A gate of the second transistor is connected to the first gate signal line, a first electrode of the second transistor is connected to a second electrode of the third transistor and a first electrode of the fourth transistor, and a second electrode of the second transistor is connected to a gate of the fourth transistor and a first electrode of the capacitor. A gate of the third transistor is connected to the second gate signal line. The second electrode of the fourth transistor is connected to a first electrode of the fifth transistor. A gate of the fifth transistor is connected to the second gate signal line, and a second electrode of the fifth transistor is connected to a first electrode of the display element, a second electrode of the capacitor, and a first electrode of the sixth transistor. A gate of the sixth transistor is connected to the first gate signal line.

Note that the number of the transistors is not limited to six and may be seven or more. In addition, the number of the capacitors and the number of the display elements are each not limited to one. One or both of the number of the capacitors and the number of the display elements may be two or more. Note that capacitors provided in series or in parallel and display elements provided in series or in parallel can be regarded as one capacitor and one display element, respectively.

Here, the first to sixth transistors have the same conductivity type. When the first to sixth transistors are n-channel transistors, the first electrode of the display element is a positive electrode and the second electrode is a negative electrode. When the first to sixth transistors are p-channel transistors, the first electrode of the display element is a negative electrode and the second electrode is a positive electrode.

In addition, when the first to sixth transistors are n-channel transistors, the potential of the first electrode of the third transistor is higher than the potential of the second electrode of the sixth transistor and the potential of the second electrode of the display element. When the first to sixth transistors are p-channel transistors, the potential of the first electrode of the third transistor is lower than the potential of the second electrode of the sixth transistor and the potential of the second electrode of the display element.

Note that when the first to sixth transistor are n-channel transistors, the potential of the second electrode of the sixth transistor may be lower than or equal to the potential of the negative electrode of the display element. Further, although the potential of the second electrode of the sixth transistor may be higher than the potential of the negative electrode of the display element, a potential difference between the second electrode of the sixth transistor and the negative electrode of the display element is preferably smaller than the threshold voltage of the display element.

In addition, the absolute value of a difference between the potential of the first electrode of the third transistor and the potential of the second electrode of the display element is preferably five times or more as large as the absolute value of the threshold voltage of the fourth transistor.

Another embodiment of the present invention is a driving method of an active matrix display device, which includes a period in which a pulse input to the second gate signal line overlaps with a pulse input to the first gate signal line in the above circuit.

One embodiment of the present invention is an active matrix display device including a circuit. The circuit includes a display element, a capacitor, a data line, a first gate signal line, a second gate signal line, a plurality of transistors (transistors A) each including a gate connected to the first gate signal line, a plurality of transistors (transistors B) each including a gate connected to the second gate signal line, and a transistor (transistor C). A first electrode of the transistor C is connected to a first electrode of one of the transistors A and a second electrode of one of the transistors B, a gate of the transistor C is connected to a second electrode of the one of the transistors A and a first electrode of the capacitor, and a second electrode of the transistor C is connected to first electrodes of the other transistors B and second electrodes of the other transistors A.

Here, first electrodes of the other transistors A may be connected to the data line. Second electrodes of the other transistors B may be connected to a first electrode of the display element. In addition, all of the transistors A, the transistors B and the transistor C may be n-channel transistors. Further, the potential of the first electrode of the transistor C may be higher than the potential of a second electrode of the display element.

One embodiment of the present invention is a driving method of the above circuit, including a first period, a second period, a third period, and a fourth period. The transistors A and the transistors B are on in the first period, the transistors A are on and the transistors B are off in the second period, the transistors A and the transistors B are off in the third period, and the transistors A are off and the transistors B are on in the fourth period.

Here, it is preferable that the second period follows the first period, the third period follows the second period, the fourth period follows the third period, and the first period follows the fourth period. Further, the length of the first period may be equal to the length the third period The above structure makes it possible to reduce the number of wirings and the number of elements (transistors) which are needed in a pixel (or a dot). For example, as compared to the example of FIG. 2, the number of the gate signal lines is reduced by three to be two. Although a driving circuit is needed because it is necessary to input a pulse to the gate signal line, when the number of the gate signals is reduced, a driving circuit for the input of the pulse is unnecessary, and therefore, power consumption can be reduced. In addition, the number of wirings is preferably small in view of increasing the integration degree.

In particular, the number of wirings which needs potential change other than the data lines (that is, the number of wirings connected to gates of the transistors) is five in FIG. 2, but is two in one embodiment of the present invention. The potential change causes increase in power consumption, and thus power consumption can be reduced by reducing the number of wirings which needs the potential change.

Although such a simplified structure is employed, variations in the threshold voltage of the transistor can be compensated like in the conventional example. In addition, deterioration over time in display characteristics which is caused when the display element (e.g., an organic EL element or a light emitting diode) is used can be compensated.

DETAILED DESCRIPTION OF THE INVENTION

Figure 1:
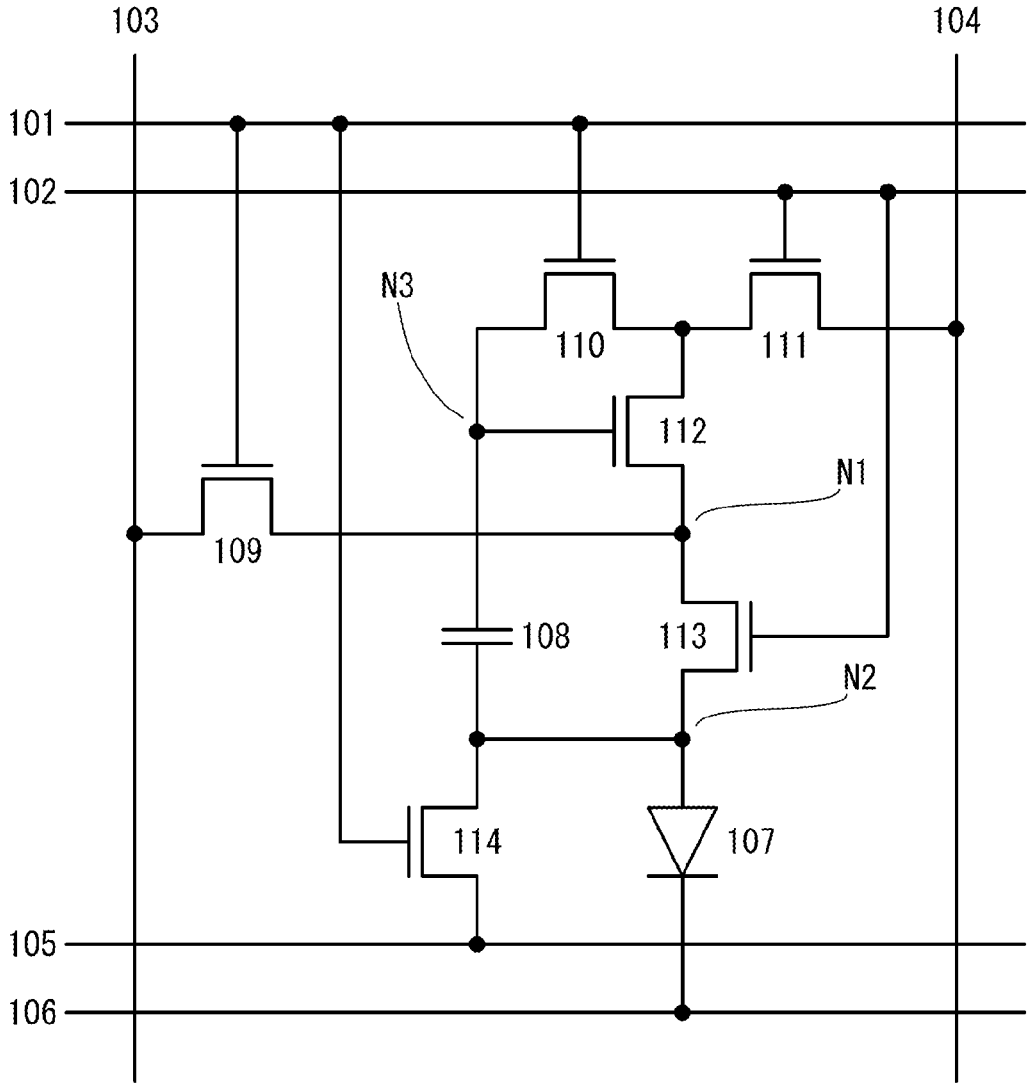
FIG. 1 illustrates an example of a circuit of a display device according to one embodiment of the present invention.
Figure 2:
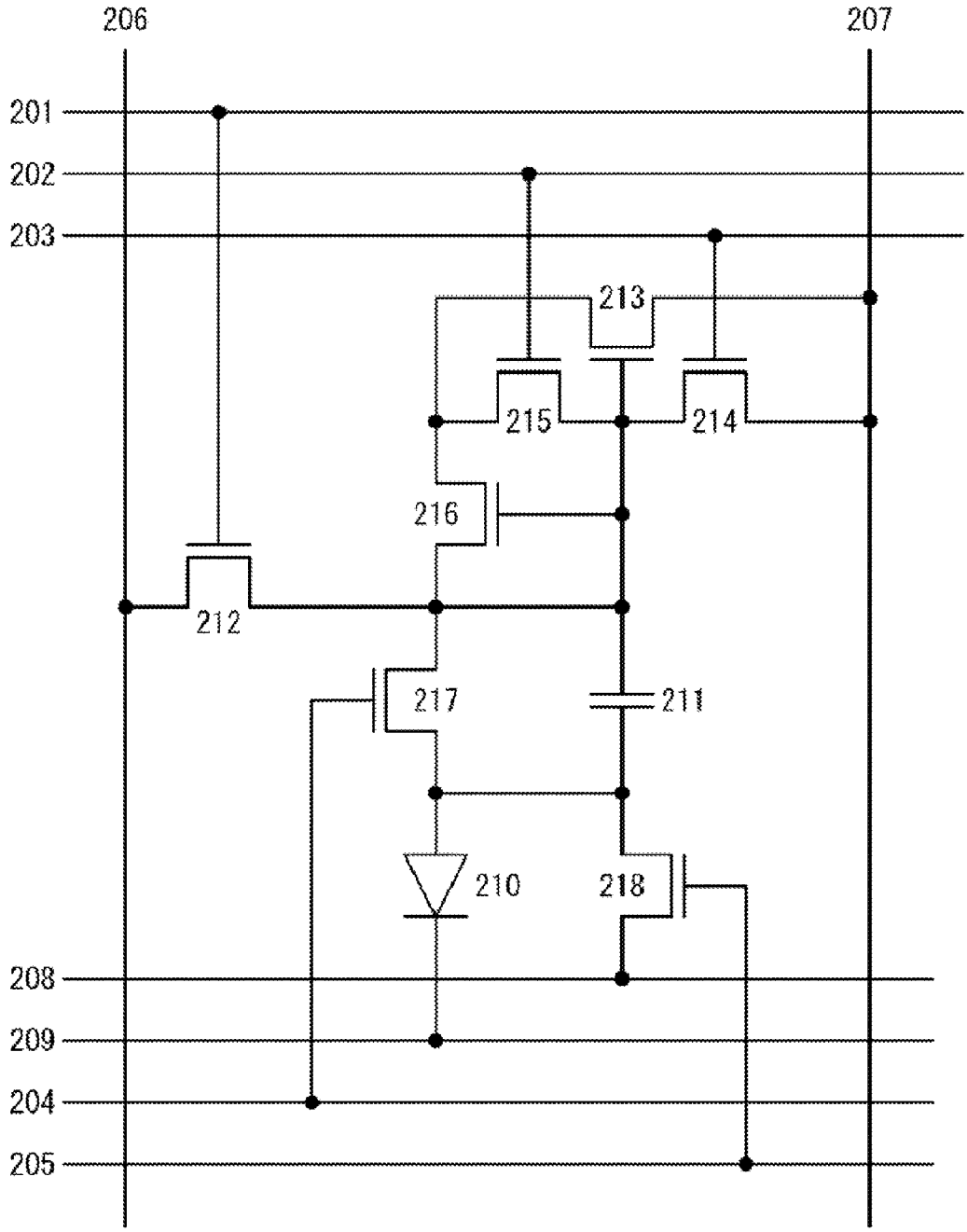
FIG. 2 Prior Art
FIG. 2 illustrates an example of a circuit of a conventional display device.

Hereinafter, embodiments will be described with reference to drawings. However, the embodiments can be implemented with various modes. It will be readily appreciated by those skilled in the art that modes and details can be changed in various ways without departing from the spirit and scope of the present invention. Thus, the present invention should not be interpreted as being limited to the following description of the embodiments.

Size, the thickness of layers, or regions in diagrams are exaggerated for simplicity in some cases. Therefore, the embodiments of the present invention are not limited to such scales.

Note that drawings are schematic views of ideal examples, and the embodiments of the present invention are not limited to the shape or the value illustrated in the drawings. For example, the following can be included: variation in shape due to a manufacturing technique or dimensional deviation; or variation in signal, voltage, or current due to noise or difference in timing.

Further, technical terms are often used in order to describe a specific embodiment, example, or the like. Note that one embodiment of the invention is not construed as being limited by the technical terms.

In addition, terms which are not defined (including terms used for science and technology, such as technical terms or academic parlance) in this specification can be used as terms which have meaning equal to general meaning that an ordinary person skilled in the art understands. It is preferable that terms defined by dictionaries or the like are construed as consistent meaning with the background of related art.

Note that what is described (or part thereof) in one embodiment can be applied to, combined with, or exchanged with another content in the same embodiment and/or what is described (or part thereof) in another embodiment or other embodiments.

The same reference numeral may indicate components which are formed using the same material or formed at the same time, but when the components need to be distinguished from each other in particular, reference numerals "_1", "_2", and the like are used for denoting the respective components. For example, a plurality of first layer wirings 303 formed using the same material are denoted by respective reference numerals, i.e., "303_1", "303_2", and the like in the drawings. The first layer wirings are collectively referred to as "first layer wirings 303" in the specification, but when one first layer wiring 303 is distinguished from the other first layer wirings 303, the one first layer wiring 303 may be referred to as a "first layer wiring 303_1".

(Embodiment 1)

FIG. 1 illustrates an example of a circuit in a display device of this embodiment. The circuit illustrated in FIG. 1 is used as one dot of the display device. The circuit includes six wiring, i.e., a first gate signal line 101, a second gate signal line 102, a data line 103, a first wiring 104, a second wiring 105, and a third wiring 106. The potentials of the first wiring 104, the second wiring 105, and the third wiring 106 are each preferably kept constant. The circuit may be designed and set up so that the second wiring 105 and the third wiring 106 of these wirings have the same potential.

In addition, the circuit includes a display element 107, a capacitor 108, a first transistor 109, a second transistor 110, a third transistor 111, a fourth transistor 112, a fifth transistor 113, and a sixth transistor 114.

A gate of the first transistor 109 is connected to the first gate signal line 101. A first electrode of the first transistor 109 is connected to the data line 103. A second electrode of the first transistor 109 is connected to a second electrode of the fourth transistor 112 and a first electrode of the fifth transistor 113.

In addition, a gate of the second transistor 110 is connected to the first gate signal line 101. A first electrode of the second transistor 110 is connected to a second electrode of the third transistor 111 and a first electrode of the fourth transistor 112. A second electrode of the second transistor 110 is connected to a gate of the fourth transistor 112 and a first electrode of the capacitor 108.

A gate of the third transistor 111 is connected to the second gate signal line 102. The second electrode of the fourth transistor 112 is connected to the first electrode of the fifth transistor 113. A gate of the fifth transistor 113 is connected to the second gate signal line 102. A second electrode of the fifth transistor 113 is connected to a first electrode of the display element 107, a second electrode of the capacitor 108, and a first electrode of the sixth transistor 114. A gate of the sixth transistor 114 is connected to the first gate signal line 101.

Further, a first electrode of the third transistor 111 is connected to the first wiring 104. A second electrode of the sixth transistor 114 is connected to the second wiring 105. A second electrode of the display element 107 is connected to the third wiring 106. The first wiring 104, the second wiring 105, and the third wiring 106 are each preferably kept at a constant potential.

An intersection point of the second electrode of the first transistor 109, the second electrode of the fourth transistor 112, and the first electrode of the fifth transistor 113 is referred to as a first node N1. An intersection point of the second electrode of the fifth transistor 113, the first electrode of the sixth transistor 114, and the first electrode of the display element 107 is referred to as a second node N2. An intersection point of the second electrode of the second transistor 110, the gate of the fourth transistor 112, and the first electrode of the capacitor 108 is referred to as a third node N3.

Here, all of the transistors are n-channel transistors. Therefore, the first electrode of the display element 107 is a positive electrode and the second electrode thereof is a negative electrode. In addition, the potential of the first wiring 104 needs to be higher than the potential of the second wiring 105 and the potential of the third wiring 106. Although a potential difference is set in consideration of the withstand voltage and the like of the circuit, as the potential different becomes larger, variations in the threshold voltage of the transistor and deterioration of the display element can be compensated for a reason described below.

Although the potential difference is also determined by the display performance of the display element 107, for example, when the threshold voltage of the fourth transistor 112 is +1 V, the potential difference between the first wiring 104 and the third wiring 106 is greater than or equal to 5 V, preferably greater than or equal to 10 V. In the description below, the potential of the first wiring 104 is referred to as $V_1$, the potential of the second wiring 105 is referred to as $V_2$, and the potential of the third wiring 106 is referred to as $V_3$. For example, the potential $V_1$, the potential $V_2$, and the potential $V_3$ can be +10 V, 0 V, and 0 V, respectively.

Figure 3:
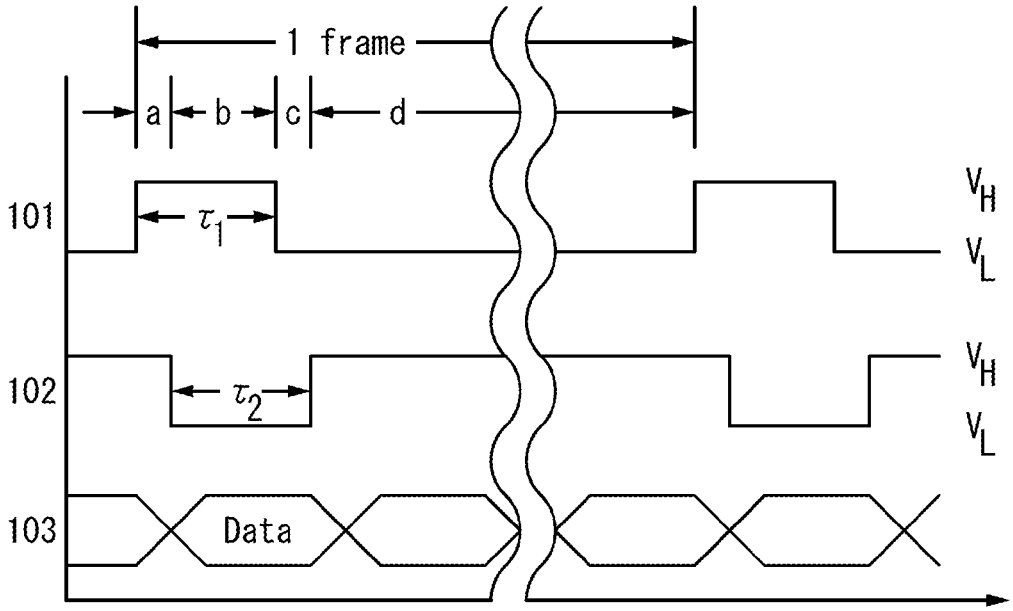
FIG. 3 shows an example of a driving method of a display device according to one embodiment of the present invention.
Figure 4A:
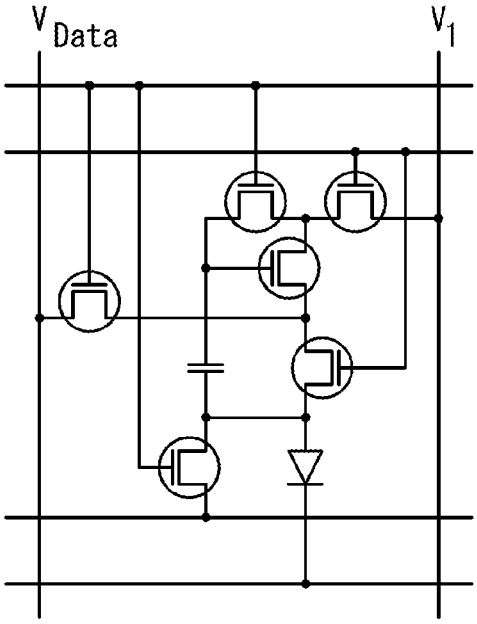
FIGS. 4A to 4D illustrate an example of a driving method of a display device according to one embodiment of the present invention.
Figure 4B:
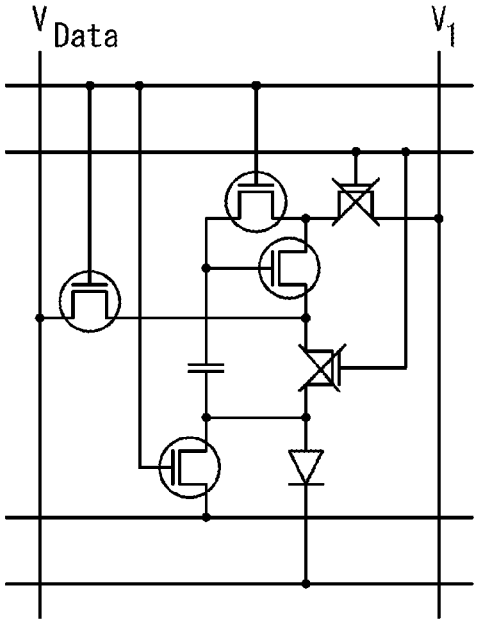
Figure 4C:
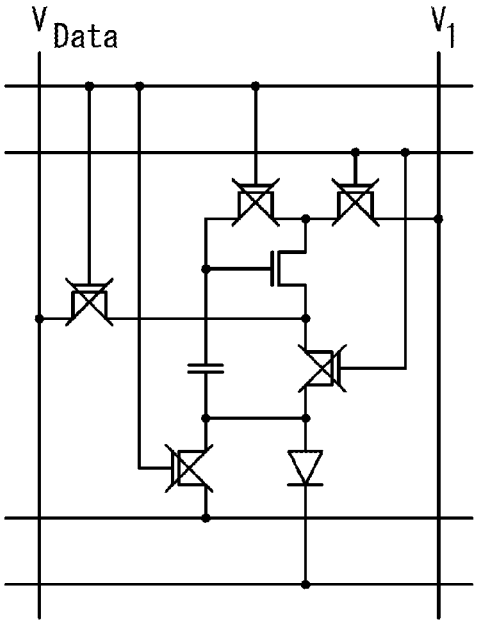
Figure 4D:
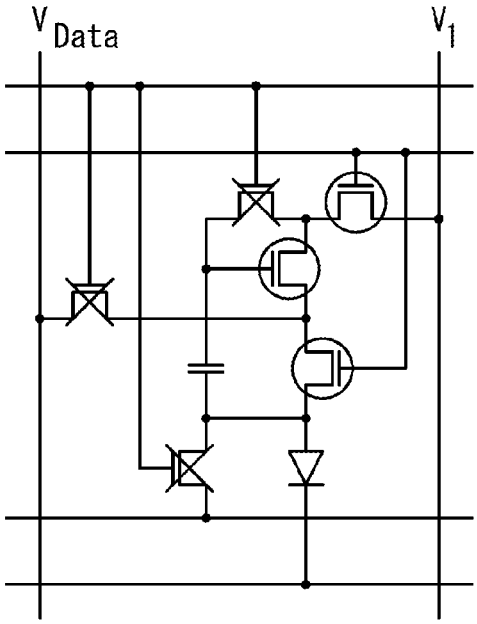

In order to drive the circuit illustrated in FIG. 1, a video data is input to the data line 103, and pulsed signals illustrated in FIG. 3 are input to the first gate signal line 101 and the second gate signal line 102. Here, $V_H$ is a potential at which the transistors are turned on, and $V_L$ is a potential at which the transistors are turned off.

As illustrated in FIG. 3, one frame includes four periods, i.e., a period a in which both the potential of the first gate signal line 101 and the potential of the second gate signal line 102 are set to $V_H$, a period b in which the potential of the first gate signal line 101 is set to $V_H$ and the potential of the second gate signal line 102 is set to $V_L$, a period c in which both the potential of the first gate signal line 101 and the potential of the second gate signal line 102 are set to $V_L$, and a period d in which the potential of the first gate signal line 101 is set to $V_L$ and the potential of the second gate signal line 102 is set to $V_H$.

Note that the length of a period $\tau_1$ in which the potential of the first gate signal line 101 is set to $V_H$ and the length of a period $\tau_2$ in which the potential of the second gate signal line 102 is set to $V_L$ may be different from each other. However, it is preferable that the circuit is designed so that the length of the period $\tau 1$ and the length of the period $\tau_2$ are the same because the circuit can be simplified. In other words, after one pulse is shaped, the pulse can be output as it is to the first gate signal line 101. On the other hand, an inverted pulse of the pulse is output through a delay circuit to be output to the second gate signal line 102.

Operation states of the transistors and the like in the respective periods are described below with reference to FIGS. 4A to 4D. FIG. 4A, FIG. 4B, FIG. 4C, and FIG. 4D illustrate the state of the transistor in the period a, that in the period b, that in the period c, and that in the period d, respectively. A circle is put over a symbol of a transistor which is in an on state, and X is put over a symbol of a transistor which is in an off state.

In the period a, all transistors which are connected to the first gate signal line 101 and the second gate signal line 102

(the first transistor 109, the second transistor 110, the third transistor 111, the fifth transistor 113, and the sixth transistor 114) are turned on. In addition, the potential of the gate and the potential of the first electrode of the fourth transistor 112 are substantially equal to $V_1$, and the potential of the second electrode of the fourth transistor 112 (the first node N1) is substantially equal to a potential $V_{Data}$ of the data line 103, but the latter is sufficiently lower than the former; therefore, the fourth transistor 112 is turned on. At this time, the potential of the first electrode of the capacitor (the third node N3) is substantially equal to $V_1$, and the potential of the second electrode of the capacitor (the second node N2) is substantially equal to $V_2$.

Note that as described above, a potential difference is generated between the first electrode and the second electrode of the fourth transistor 112 which is in an on state, and similarly, a potential difference is generated between the first electrode and the second electrode of the fifth transistor 113 which is in an on state; therefore, the fourth transistor 112 and the fifth transistor 113 consume power. Accordingly, the period a is preferably as short as possible and is preferably set to 100 nsec to 500 nsec.

In the period b, since the potential of the second gate signal line 102 is set to $V_L$, the third transistor 111 and the fifth transistor 113 which are connected to the second gate signal line 102 are turned off At the beginning of the period b, the potential of the third node N3 has the same level as the potential thereof in the period a. On the other hand, the first transistor 109, the second transistor 110, and the sixth transistor 114 are on. Therefore, the potential of the first node N1 is the potential $V_{Data}$ of the data line. In addition, the potential of the second node N2 is set to $V_2$.

Since the fourth transistor 112 is on and the potential $V_{Data}$ is lower than the potential $V_1$, charge flows from the third node N3 to the first node N1 via the first electrode of the fourth transistor 112. With this flow of charge, the potential of the third node N3 is lowered. The lowering of the potential of the third node N3 caused by the flow of charge continues until the potential of the third node N3 becomes $(V_{Data}+V_{th})$. That is, a potential difference between the first electrode and the second electrode of the capacitor 108 is $(V_{Data}+V_{th}-V_2)$.

In the period c, since the potential of the first gate signal line 101 is also set to $V_L$, the first transistor 109, the second transistor 110, and the sixth transistor 114 which are connected to the first gate signal line 101 are turned off Here, the potentials of the first node N1, the second node N2, and the third node N3 have substantially the same level as those in the period b.

In the period d, since the potential of the second gate signal line 102 is set to $V_H$, the third transistor 111 and the fifth transistor 113 which are connected to the second gate signal line 102 are turned on. At the beginning of the period d, the potential of the second node N2 is set to $V_2$; therefore, the fifth transistor 113 is turned on, whereby the potential of the second electrode of the fourth transistor 112 is also set to $V_2$. In addition, since the third transistor 111 is turned on, the potential of the first electrode of the fourth transistor 112 is set to $V_1$.

At this time, the potential of the gate of the fourth transistor 112 is $(V_{Data}+V_{th})$, and the first electrode has a higher potential than the second electrode. Therefore, a potential difference between the gate and the second electrode of the fourth transistor 112 $(V_{Data}+V_{th}-V_2)$ is smaller than a potential difference between the first electrode and the second electrode $(V_1-V_2)$, and a current I flowing between the first electrode and the second electrode depends on a formula of a drain current in a saturation region.

That is, the current I is proportional to a square of a value which is obtained by subtracting the threshold voltage from the potential different between the gate and a source (which is the second electrode in this case). In this case, the second electrode of the fourth transistor 112 corresponds to the source.

$$I \propto \{(V_{Data}+V_{th}-V_2)-V_{th}\}^2=(V_{Data}-V_2)^2 \quad \text{(Formula 1)}$$

As is obvious from Formula 1, the current I does not depend on the threshold voltage of the fourth transistor 112.

The more current flows and the more charge is accumulated in the second node, the more the potential of the second node N2 is increased. However, the increase in the potential of the second node N2 becomes an increase in the potential of the third node N3 owing to a capacitor coupling through the capacitor 108. Therefore, the difference between the potential of the third node N3 and the potential of the second node N2 is not changed. In short, the current I is constant irrespective of the potential of the second node N2.

As the potential of the second node N2 is increased, current flows in the display element 107 more easily, and when the potential of the second node N2 reaches a certain value, the current flowing in the display element 107 and the current I are in balance. That is, the potential of the second node N2 becomes constant. Although the display state (the amount of light emission, the transmittance, the reflectance, the color tone, the chroma, and the like) of the display element 107 is changed depending on the value of current flowing in the display element 107, as is obvious from Formula 1, the state is determined by the potential $V_{Data}$ of the data line and the like. In this manner, the variations in the threshold voltages of the transistors can be compensated.

Note that as is obvious from Formula 1, in order that the current I is constant, it is necessary that the potential of the third node N3 is constant. When the potential of the third node N3 is changed, the current I is also changed in response to the change. For example, when off-state characteristics of the second transistor 110 are insufficient, the potential of the third node N3 is increased within one frame period.

The current I is also increased in response to the increase in the potential of the third node N3. Such change appears as a defect in an individual pixel or dot and might occurs throughout the display device. Too much change causes a display defect such as a flicker. Therefore, it is particularly preferable that the off-state characteristics of the second transistor 110 are sufficient (that is, the off-state current is sufficiently low).

(Embodiment 2)

In this embodiment, a display device of one embodiment of the present invention will be described with reference to FIGS. 5A to 5C, FIGS. 6A to 6C, and FIGS. 7A and 7B. In this embodiment, a display device including an organic EL element as a light-emitting element is described. In particular, a top-emission display device is described in which a light-emitting layer is formed over an active matrix circuit and which emits light in an upward direction with respect to the active matrix circuit to perform display.

Figure 5A:
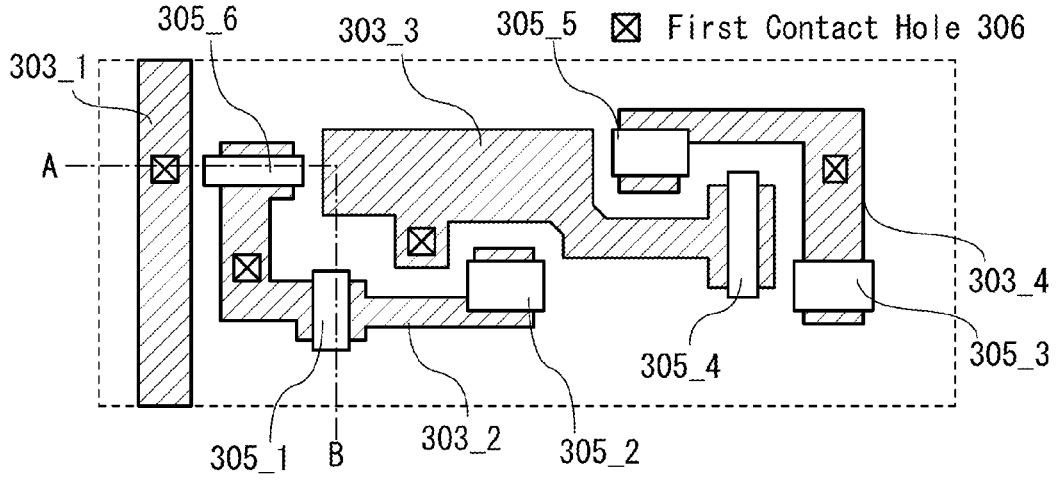
FIGS. 5A to 5C are top views illustrating an example of a display device according to one embodiment of the present invention.
Figure 5B:
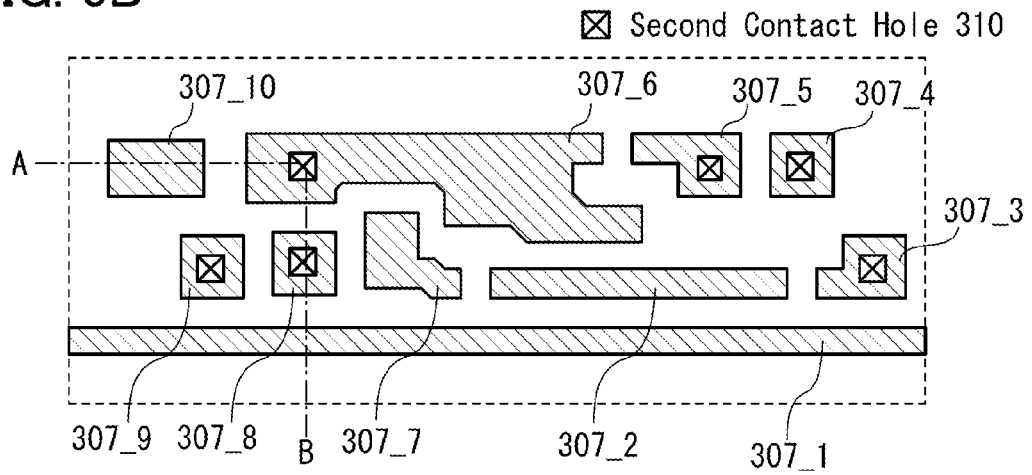
Figure 5C:
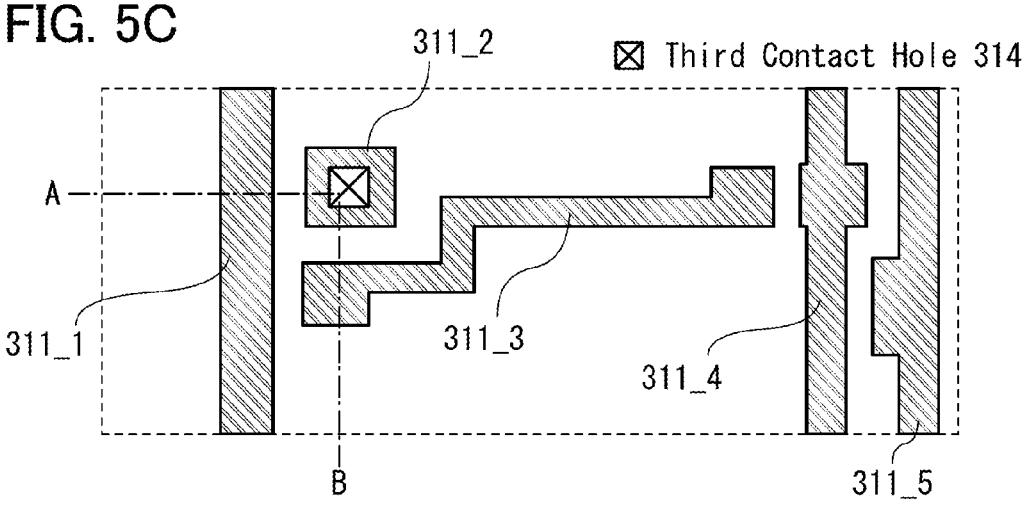

FIGS. 5A to 5C illustrate the layout of wirings, contact holes, semiconductor layers, and the like which are used for forming one dot of the display device. Note that insulating films and the like are not illustrated. A rectangle formed with a dotted line in each view represents one dot.

FIG. 5A illustrates the positions of first layer wirings 303, semiconductor layers 305, and first contact holes 306 which connects the first layer wirings to upper wirings. Among them, a first layer wiring 303_1 is a wiring corresponding to the second wiring 105 in FIG. 1. A first layer wiring 303_2 corresponds to part of the first gate signal line 101 in FIG. 1.

A first layer wiring 303_4 corresponds to part of the second gate signal line 102 in FIG. 1. Part of a first layer wiring 303_3 corresponds to part of the first electrode of the capacitor 108 in FIG. 1. The other first layer wirings 303 correspond to the gates of the first transistor 109 to the sixth transistor 114 in FIG. 1.

In addition, a semiconductor layer 305_1, a semiconductor layer 305_2, a semiconductor layer 305_3, a semiconductor layer 305_4, a semiconductor layer 305_5, and a semiconductor layer 305_6 correspond to the semiconductor layer of the first transistor 109, the semiconductor layer of the second transistor 110, the semiconductor layer of the third transistor 111, the semiconductor layer of the fourth transistor 112, the semiconductor layer of the fifth transistor 113, and the semiconductor layer of the sixth transistor 114 in FIG. 1, respectively.

FIG. 5B illustrates the positions of second layer wirings 307 and second contact holes 310 for connection to wirings thereabove. Among them, a second layer wiring 307_1 corresponds to the data line 103 in FIG. 1, and part of a second layer wiring 307_6 corresponds to part of the second electrode of the capacitor 108 in FIG. 1. The other second layer wirings 307 correspond to the first electrodes and the second electrodes of the first transistor 109 to the sixth transistor 114 in FIG. 1.

FIG. 5C illustrates the positions of third layer wirings 311 and a third contact hole 314 for connection to a first electrode of a display element. Among them, a third layer wiring 311_1 corresponds to part of the first gate signal line 101 in FIG. 1, a third layer wiring 311_4 corresponds to part of the second gate signal line 102 in FIG. 1, and a third layer wiring 311_5 corresponds to part of the first wiring 104 in FIG. 1.

When the wirings, the semiconductor layers, the contact holes, and the like which have the shapes illustrated in FIGS. 5A to 5C are stacked, the circuit used for the display device can be manufactured. A method for manufacturing the display device is described below with reference to FIGS. 6A to 6C and FIGS. 7A and 7B. Note that FIGS. 6A to 6C and FIGS. 7A and 7B are cross-sectional views of manufacturing steps, which correspond to a cross-section along an alternate long and short dashed line A-B in FIGS. 5A to 5C.

Figure 6A:
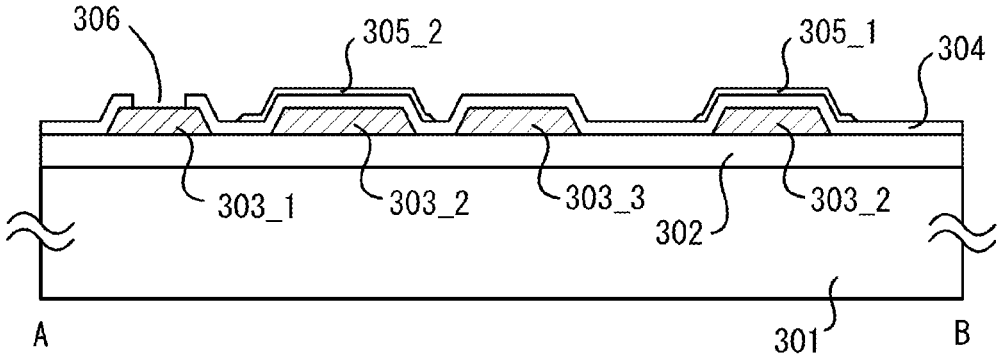
FIGS. 6A to 6C are cross-sectional process views illustrating an example of a manufacturing process of a display device according to one embodiment of the present invention.

A base insulating layer 302 is formed over a first substrate 301 having an insulating surface. Then, after a conductive layer is formed, a first photolithography step is performed, so that a resist mask is formed. Unnecessary portions are removed by etching, whereby the first layer wirings 303 are formed. The etching is preferably performed so that end portions of the first layer wirings 303 have tapered shapes as illustrated in FIG. 6A because coverage with a film stacked thereover can be improved.

Although there is no particular limitation on a substrate which can be used as the first substrate 301, the substrate needs to have at least heat resistance to withstand later heat treatment. Although a glass substrate can be used as the first substrate 301, this embodiment is not limited thereto. Any of various materials such as a transparent material, an opaque material, an insulating material, and a conductive material can be used. In particular, in this embodiment, the substrate does not need to be transparent because light used for display is emitted in an upward direction with respect to the first substrate. For example, to increase a heat dissipation property, a metal material can be used.

In the case where a glass substrate is used as the first substrate, when the temperature of the heat treatment to be performed later is high, a glass substrate whose strain point is higher than or equal to 730° C. is preferably used. As the glass substrate, a glass material such as aluminosilicate glass, aluminoborosilicate glass, or barium borosilicate glass is used, for example. Note that by containing a larger amount of barium oxide (BaO) than boric oxide, a glass substrate is heat-resistant and of more practical use. Therefore, a glass substrate containing BaO and $B_2O_3$ so that the amount of BaO is larger than that of $B_2O_3$ is preferably used.

Note that, instead of the glass substrate described above, a substrate formed using an insulator, such as a ceramic substrate, a quartz substrate, or a sapphire substrate, may be used. Alternatively, crystallized glass or the like may be used.

The base insulating layer 302 has a function of preventing diffusion of impurity elements from the first substrate 301. In addition, in the case where the first substrate 301 is conductive, the base insulating layer 302 also has a function of keeping the insulating property of the circuit. The base insulating layer 302 can be formed with a stacked-layer structure including one or more films selected from a silicon nitride film, a silicon oxide film, a silicon nitride oxide film, and a silicon oxynitride film.

The first layer wirings 303 can be formed with a single layer or a stack of layers using a metal material such as Mo, Ti, Cr, Ta, W, Al, Cu, Pt or Pd, or an alloy material containing the above metal material as its main component. For example, a structure in which indium nitride or molybdenum oxide which has a high work function is stacked over titanium can be employed.

Next, a gate insulator 304 is formed over the first layer wirings 303. The gate insulator 304 can be formed with a single layer or a stack of layers using a silicon oxide layer, a silicon nitride layer, a silicon oxynitride layer, a silicon nitride oxide layer, or an aluminum oxide layer by a plasma CVD method, a sputtering method, or the like. For example, a silicon oxynitride film may be formed using $SiH_4$ and $N_2O$ as a deposition gas by a plasma CVD method.

Next, a semiconductor layer is formed, and the island-shaped semiconductor layers 305 are formed by a second photolithography step. The semiconductor layers 305 can be formed using a material such as a silicon semiconductor or an oxide semiconductor. As a silicon semiconductor, single crystal silicon, polycrystalline silicon, or the like can be used. As an oxide semiconductor, an In—Ga—Zn-based oxide or the like can be used as appropriate.

Note that here, for example, an "In—Ga—Zn-based oxide" means an oxide containing In, Ga, and Zn as its main component and there is no particular limitation on the ratio of In:Ga:Zn. The In—Ga—Zn-based oxide may contain a metal element other than the In, Ga, and Zn.

For example, in view of improving a display quality, it is preferable that the semiconductor layers 305 are formed using an oxide semiconductor that is an In—Ga—Zn-based oxide to be semiconductor layers with small off-state currents because leakage current of the transistor is reduced and, in particular, the potential of the third node N3 in FIG. 1 is kept constant.

Note that the oxide semiconductor is not limited to an In—Ga—Zn-based oxide, and an oxide semiconductor containing at least indium (In) or zinc (Zn) may be used. In particular, In and Zn are preferably contained. As a stabilizer for reducing variations in electric characteristics of a transistor using the oxide semiconductor, gallium (Ga) is preferably additionally contained. Tin (Sn) is preferably contained as a stabilizer. Hafnium (Hf) is preferably contained as a stabilizer. Aluminum (Al) is preferably contained as a stabilizer.

As another stabilizer, one or plural kinds of lanthanoid such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), or lutetium (Lu) may be contained.

As other oxide semiconductors, for example, the following can be given: indium oxide, tin oxide, zinc oxide; a two-component metal oxide such as an In—Zn-based oxide, a Sn—Zn-based oxide, an Al—Zn-based oxide, a Zn—Mg-based oxide, a Sn—Mg-based oxide, an In—Mg-based oxide, or an In—Ga-based oxide; a three-component metal oxide such as an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, or an In—Lu—Zn-based oxide, a Sn—Ga—Zn-based oxide, an Al—Ga—Zn-based oxide, a Sn—Al—Zn-based oxide; a four-component metal oxide such as an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

For example, an In—Ga—Zn-based oxide with an atomic ratio of In:Ga:Zn=1:1:1 (=1/3:1/3:1/3) or In:Ga:Zn=2:2:1 (=2/5:2/5:1/5), or an oxide with an atomic ratio close to the above atomic ratios can be used. Alternatively, an In—Sn—Zn-based oxide with an atomic ratio of In:Sn:Zn=1:1:1 (=1/3:1/3:1/3), In:Sn:Zn=2:1:3 (=1/3:1/6:1/2), or In:Sn:Zn=2:1:5 (=1/4:1/8:5/8), or an oxide with an atomic ratio close to the above atomic ratios may be used.

However, without limitation to the materials given above, a material with an appropriate composition may be used depending on needed semiconductor characteristics (e.g., mobility, threshold voltage, and variation). In order to obtain the needed semiconductor characteristics, it is preferable that the carrier density, the impurity concentration, the defect density, the atomic ratio between a metal element and oxygen, the interatomic distance, the density, and the like are set to appropriate values.

For example, high mobility can be obtained relatively easily in the case of using an In—Sn—Zn-based oxide. However, even with an In—Ga—Zn-based oxide, mobility can be increased by reducing the defect density in the bulk.

Note that for example, the expression "the composition of an oxide containing In, Ga, and Zn at the atomic ratio, In:Ga:Zn=a:b:c (a+b+c=1), is in the neighborhood of the composition of an oxide containing In, Ga, and Zn at the atomic ratio, In:Ga:Zn=A:B:C (A+B+C=1)" means that a, b, and c satisfy the following relation: $(a-A)^2+(b-B)^2+(c-C)^2 \leq r^2$, and r may be 0.05, for example. The same applies to other oxides.

The oxide semiconductor may be either single crystal or non-single-crystal. In the latter case, the oxide semiconductor may be either amorphous or polycrystal. Further, the oxide semiconductor may have either an amorphous structure including a portion having crystallinity or a non-amorphous structure.

In an oxide semiconductor in an amorphous state, a flat surface can be obtained with relative ease, so that when a transistor is manufactured with the use of the oxide semiconductor, interface scattering can be reduced, and relatively high mobility can be obtained with relative ease.

In an oxide semiconductor having crystallinity, defects in the bulk can be further reduced and when a surface flatness is improved, mobility higher than that of an oxide semiconductor layer in an amorphous state can be obtained. In order to improve the surface flatness, the oxide semiconductor is preferably formed over a flat surface. Specifically, the oxide semiconductor may be formed over a surface with the average surface roughness (Ra) of less than or equal to 1 nm, preferably less than or equal to 0.3 nm, more preferably less than or equal to 0.1 nm.

After the semiconductor layers 305 are formed, the first contact holes 306 reaching the first layer wirings are formed in part of the gate insulator 304 by a third photolithography step. A formation method of the first contact holes 306 can be appropriately selected from dry etching, wet etching, and the like. A cross-section at this stage is illustrated in FIG. 6A.

Next, a conductive film is formed over the gate insulator 304 and the semiconductor layers 305, and then the second layer wirings 307 are formed by a fourth photolithography step. As the conductive film used for the second layer wirings 307, for example, a metal film containing an element selected from Al, Cr, Cu, Ta, Ti, Mo, and W, a metal nitride film containing any of the above elements as a component (such as a titanium nitride film, a molybdenum nitride film, or a tungsten nitride film), or the like can be used.

Alternatively, a film of a high-melting-point metal such as Ti, Mo, or W or a metal nitride film of any of these elements (a titanium nitride film, a molybdenum nitride film, or a tungsten nitride film) may be stacked on one of or both a bottom side and a top side of a metal film of Al, Cu, or the like.

The second layer wirings 307 may be formed using a conductive metal oxide. As the conductive metal oxide, indium oxide, tin oxide, zinc oxide, an In—Sn-based oxide (e.g., ITO), an In—Zn-based oxide, or any of these metal oxide materials to which silicon oxide is added can be used.

Next, a first interlayer insulator 308 and a second interlayer insulator 309 are formed over the semiconductor layers 305 and the second layer wirings 307. As the first interlayer insulator 308, an inorganic insulating film such as a silicon oxide film or a silicon oxynitride film can be used. As the second interlayer insulator 309, an insulating film with a planarization function is preferably selected in order to reduce surface unevenness due to the transistor. For example, an inorganic material such as SOG (spin-on-glass), or an organic material such as polyimide, acrylic, or benzocyclobutene can be used. The second interlayer insulator 309 may be formed by stacking a plurality of insulating films formed using any of these materials.

Figure 6B:
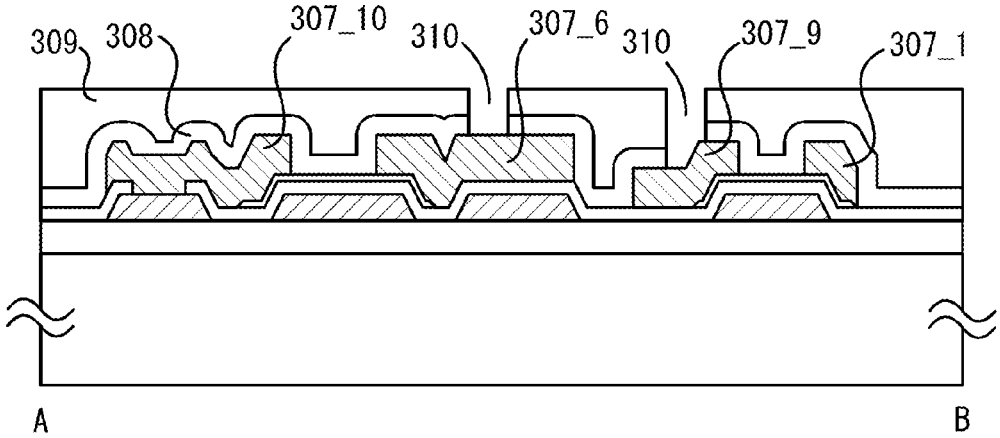

Next, the second contact holes 310 reaching the second layer wirings 307 are formed in the first interlayer insulator 308 and the second interlayer insulator 309 by a fifth photolithography step. A formation method of the second contact holes 310 can be appropriately selected from dry etching, wet etching, and the like. The state at this stage is illustrated in FIG. 6B.

Next, a conductive film is formed over the second interlayer insulator, and then the third layer wirings 311 are formed by a sixth photolithography step. The conductive film used for the third layer wiring 311 can be selected from materials which can be used for the second layer wirings 307. However, a material having low resistivity is particularly preferable, and Cu or an alloy thereof is preferably used.

Then, a third interlayer insulator 312 and a fourth interlayer insulator 313 are formed over the third layer wirings 311. The third interlayer insulator 312 and the fourth interlayer insulator 313 can each be formed using a material which can be used for the first interlayer insulator 308 or the second interlayer insulator 309.

Figure 6C:
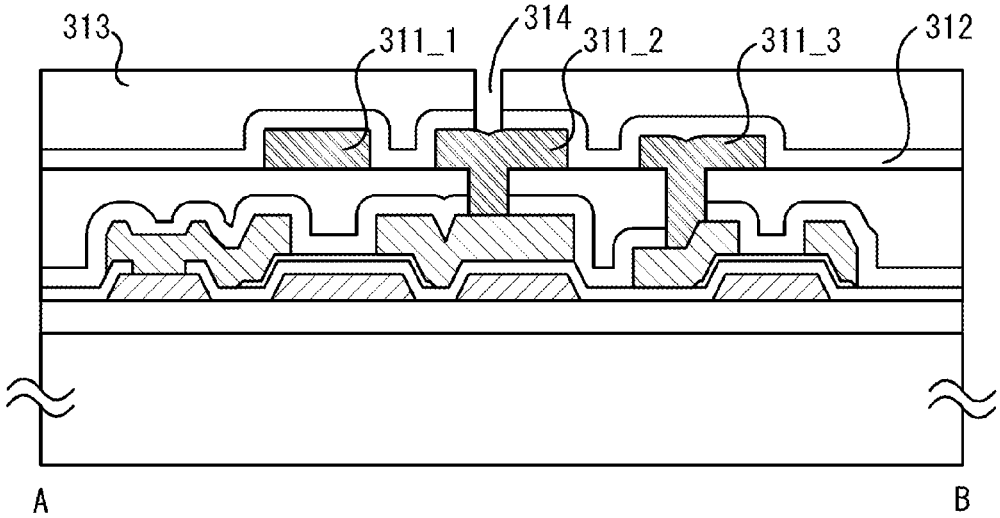

Next, the third contact hole 314 reaching the third layer wiring 311 is formed in the third interlayer insulator 312 and the fourth interlayer insulator 313 by a seventh photolithography step. A formation method of the third contact hole 314 can be appropriately selected from dry etching, wet etching, and the like. The state at this stage is illustrated in FIG. 6C.

Next, a conductive film is formed over the fourth interlayer insulator 313, and then a reflective electrode layer 315 is formed by an eighth photolithography step. The reflective electrode layer 315 corresponds to the first electrode of the display element 107 in FIG. 1. In order to improve light extraction efficiency, a material which efficiently reflects light which is emitted from a light-emitting layer 317 formed later is preferable as the reflective electrode layer 315.

The reflective electrode layer 315 may have a stacked-layer structure. For example, a conductive film of metal oxide, a titanium film, or the like may be formed thin on the side which is in contact with the light-emitting layer 317, and a metal film which has high reflectance (aluminum, an alloy of aluminum, silver, or the like) may be formed on the other side. Such a structure is preferable because formation of an insulating film between the light-emitting layer 317 and the metal film with high reflectance (the film of aluminum, an alloy of aluminum, silver, or the like) can be prevented.

Next, partitions 316 are formed over the reflective electrode layer 315. The partitions 316 are formed using an organic insulating material or an inorganic insulating material. It is particularly preferable that the partitions are formed using a photosensitive resin material to have an opening over the reflective electrode layer 315 so that a sidewall of the opening is formed as an inclined surface with continuous curvature.

Next, the light-emitting layer 317 is formed over the reflective electrode layer 315 and the partitions 316, and then a transmissive electrode layer 318 is formed over the light-emitting layer 317. The light-emitting layer 317 may be formed with a single layer or a stack of layers, and in this embodiment, light emitted from the light-emitting layer 317 is preferably white, and preferably has peaks in each of red, green, and blue wavelength regions.

In this embodiment, an organic EL material is used for the light-emitting layer 317, and thus the light-emitting layer 317 is preferably formed by a vacuum evaporation method. In addition, in view of the characteristics, it is difficult that the light-emitting layer 317 and a film thereover are patterned by photolithography steps. Therefore, the light-emitting layer 317 and the transmissive electrode layer 318 are formed evenly over the first substrate. Note that the transmissive electrode layer 318 corresponds to the second electrode of the display element 107 in FIG. 1.

Figure 7A:
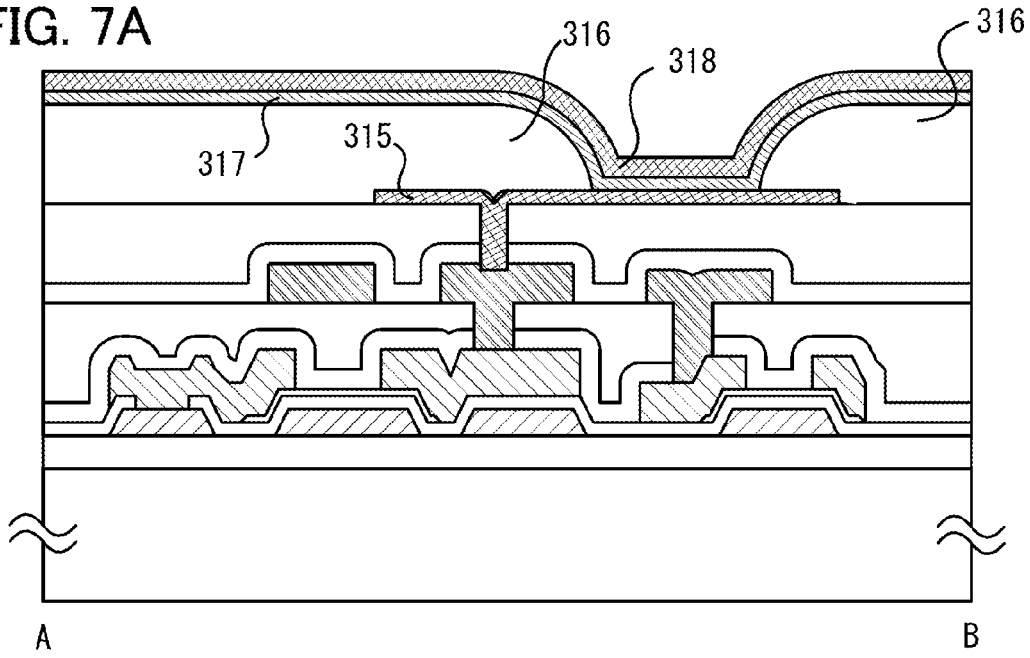
FIGS. 7A and 7B are cross-sectional process views illustrating an example of a manufacturing process of a display device according to one embodiment of the present invention.

Through the above steps, the transistor which controls the driving of the light emitting element, and the light-emitting layer 317 are formed. The state at this stage is illustrated in FIG. 7A.

Next, a method for manufacturing a second substrate 319 provided with a light-blocking film 320, a color filter 321, and an overcoat film 322 is described below. Although the second substrate 319 needs to be transparent, fewer conditions are required for the second substrate 319 than for the first substrate 301, and, for example, a material having low heat resistance can also be used.

First, an opaque film is formed over the second substrate 319, and a photolithography step is performed, so that the light-blocking film 320 is formed. The light-blocking film 320 can prevent color mixture between pixels and light leakage. Note that the light-blocking film 320 is not necessarily provided. As the light-blocking film 320, a metal film having a low reflectance, such as a titanium film or a chromium film, an organic resin film which is impregnated with black pigment or black dye, or the like can be used.

Then, the color filter 321 is formed over the second substrate 319 and the light-blocking film 320. The color filter 321 is a colored layer for transmitting light in a specific wavelength range. For example, a red (R) color filter for transmitting light in a red wavelength range, a green (G) color filter for transmitting light in a green wavelength range, a blue (B) color filter for transmitting light in a blue wavelength range, or the like can be used. Each color filter is formed in a desired position with a known material by a printing method, an inkjet method, an etching method using a photolithography technique, or the like.

Although a method using three colors of RGB is described in this embodiment, this embodiment is not limited thereto, and four colors including Y (yellow) in addition to RGB, or five or more colors may alternatively be employed.

Next, the overcoat film 322 is formed over the light-blocking film 320 and the color filter 321. The overcoat film 322 can be formed using an organic resin film of acrylic, polyimide, or the like. The overcoat film 322 can prevent diffusion of an impurity component and the like contained in the color filter 321 toward the light-emitting layer 317. Further, the overcoat film 322 may have a stacked-layer structure of an organic resin film and an inorganic insulating film. Silicon nitride, silicon oxide, or the like can be used as the inorganic insulating film. Note that the overcoat film 322 is not necessarily provided.

Through the above steps, the second substrate 319 provided with the light-blocking film 320, the color filter 321, and the overcoat film 322 is formed. Then, the first substrate 301 and the second substrate 319 are aligned and attached to each other to form the display device.

There is no particular limitation on the attachment of the first substrate 301 and the second substrate 319, and the first substrate 301 and the second substrate 319 can be attached to each other with a light-transmitting adhesive which has high refractive index and is capable of performing bonding, for example. A space 323 is formed by sealing between the first substrate 301 and the second substrate 319. There is no particular limitation on the space 323 as long as it transmits light and does not allow the outside air to enter thereinto.

However, it is preferable that the space 323 is filled with a light-transmitting material whose refractive index is higher than that of air. In the case where the refractive index is low, light emitted from the light-emitting layer 317 in an oblique direction is further refracted by the space 323, and the light is emitted from an adjacent pixel in some cases. Thus, for example, the space 323 can be filled with a light-transmitting adhesive having high refractive index and capable of bonding the first substrate 301 and the second substrate 319 to each other.

Alternatively, an inert gas such as nitrogen or argon or the like can be used. Further alternatively, desiccant or the like may be dispersed into the space 323. The state at this stage is illustrated in FIG. 7B.

Figure 7B:
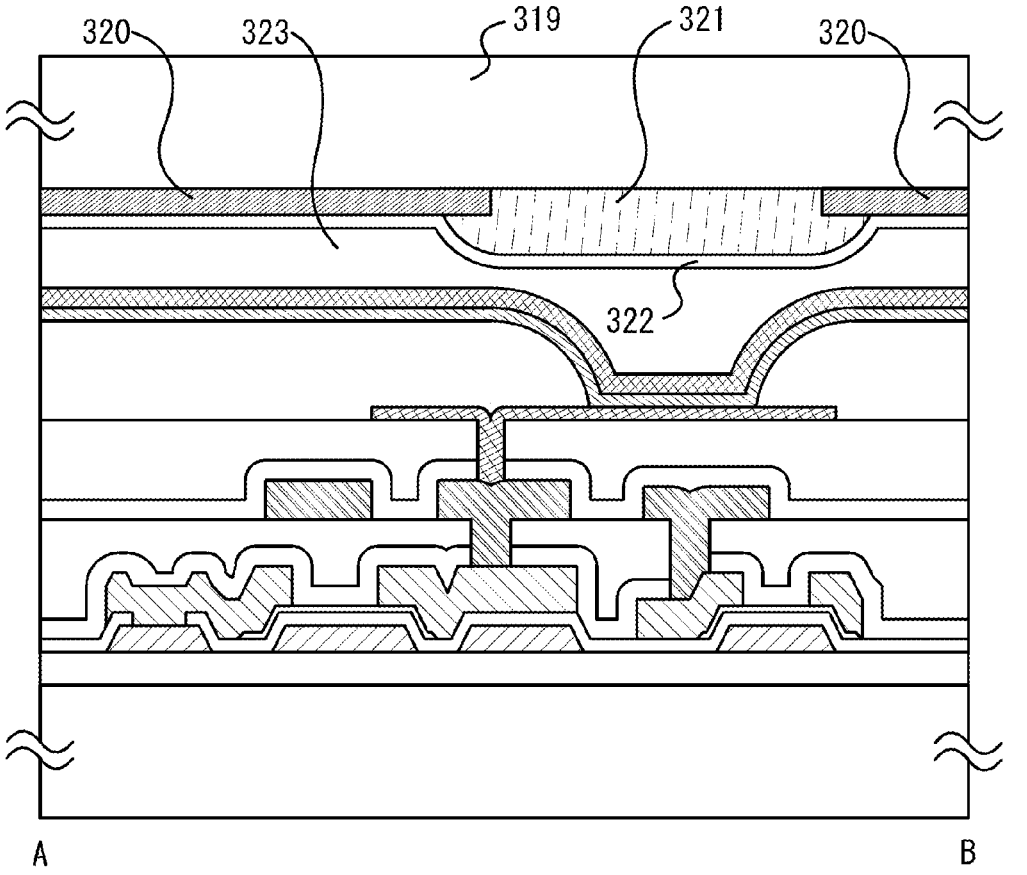

The display device illustrated in FIG. 7B is a so-called top-emission display device in which light is emitted from the light-emitting layer 317 toward the second substrate 319. In addition, white light emitted from the light-emitting layer 317 is subjected to color separation by the color filter 321.

Such a top-emission display device in which the white-light-emitting element and the color filter are used in combination (the structure is hereinafter abbreviated as a white+CF+TE structure) is compared to a top-emission display device in which light-emitting elements are formed using a separate coloring method (the structure is hereinafter abbreviated as a separate coloring+TE structure). The separate coloring method is a method for separately coloring R, G, and B materials in pixels by an evaporation method or the like.

First, in the white+CF+TE structure, coloring is performed using a color filter; thus, a color filter is needed. In contrast, in the separate coloring+TE structure, coloring is performed by separately coloring pixels by evaporation or the like; thus, a color filter is not needed. Note that although the white+CF+TE structure needs a color filter, the separate coloring+TE structure needs a metal mask or the like for separate coloring. Separate coloring can also be performed using an inkjet method or the like without using a metal mask; however, many technical problems have remained.

In the case where a metal mask is used, an evaporation material is also deposited on the metal mask; thus, material use efficiency is low and cost is high. Further, the metal mask is in contact with the light-emitting element, so that yield is decreased because of damage to the light-emitting element or generation of a scratch, a particle, or the like due to contact.

Next, as for the pixel size, a margin for separate coloring needs to be provided between pixels in the separate coloring+TE structure. Thus, the size of each pixel cannot be increased. Consequently, the aperture ratio is markedly decreased. In contrast, in the white+CF+TE structure, it is not necessary to provide a region necessary for separate coloring between the pixels; thus, the size of one pixel can be increased. Consequently, the aperture ratio can be improved.

In the case of manufacturing a large-size display device, a manufacturing technique adaptable for the display device is indispensable. It is difficult to employ the separate coloring+TE structure because a metal mask is needed for separate coloring and a technique of a metal mask and production equipment that are compatible with a large display panel are not established. Even if the technique of a metal mask and the production equipment that are compatible with a large display panel are established, the problem of material use efficiency, i.e., the fact that an evaporation material is also deposited on a metal mask, is not solved. On the other hand, the white+CF+TE structure can be manufactured with an existing production facility because a metal mask is not needed, which is preferable.

A manufacturing device of a display device is an indispensable factor for the yield of the display devices. For example, in the case where a light-emitting element has a stacked-layer structure of a plurality of films, it is preferable that the apparatus for manufacturing a display device is an in-line apparatus or a multi-chamber apparatus and that a plurality of evaporation sources is formed on a substrate once or successively. In the separate coloring+TE structure, it is necessary to separately color pixels and to manufacture the display panel while replacing metal masks so that the pixels are formed in desired positions. Since metal masks are replaced, it is difficult to use an in-line manufacturing apparatus or a multi-chamber manufacturing apparatus. In contrast, in the white+CF+TE structure, it is easy to use an in-line manufacturing apparatus or a multi-chamber manufacturing apparatus because a metal mask is not needed.

(Embodiment 3)

In this embodiment, specific examples of electronic devices each of which is manufactured using the display device described in any of the above embodiments are described with reference to FIGS. 8A to 8D.

Examples of electronic devices to which one embodiment of the present invention can be applied include a television set (also referred to as a television or a television receiver), a monitor of a computer or the like, a camera such as a digital camera or a digital video camera, a digital photo frame, a mobile phone, a portable game machine, a portable information terminal, an audio reproducing device, a game machine (e.g., a pachinko machine or a slot machine), a housing of a game machine, and the like. The specific examples of these electronic devices are illustrated in FIGS. 8A to 8D.

Figure 8A:
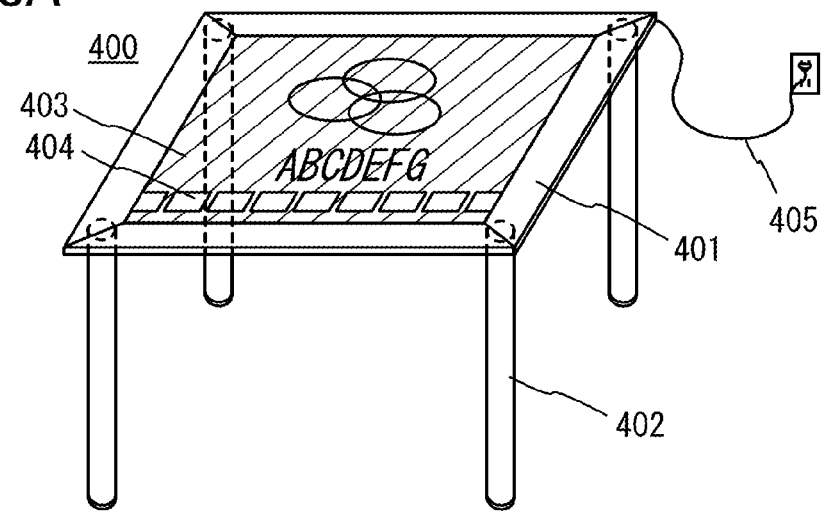
FIGS. 8A to 8D each illustrate an electronic device including a display device.

FIG. 8A illustrates a table 400 including a display portion. In the table 400, a display portion 403 is incorporated in a housing 401. A display device manufactured according to one embodiment of the present invention can be used in the display portion 403, so that an image can be displayed on the display portion 403. Note that the housing 401 is supported by four legs 402. In addition, the housing 401 includes a power supply cord 405 for supplying power.

The display portion 403 has a touch-input function. When a user touches displayed buttons 404 which are displayed on the display portion 403 of the table 400 with his/her fingers or the like, the user can carry out operation on the screen and input of information. In addition, owing to a hinge provided in the housing 401, the screen of the display portion 403 can stand perpendicularly to a floor, so that the table 400 can be used as a television set. A television set with a large screen takes up too much space that is available in a small room. However, with a table including a display portion therein, it is possible to make the use of the space in the room.

When a display device described in the above embodiment is used in the display portion 403, the display portion 403 can have a higher display quality than the conventional one.

Figure 8B:
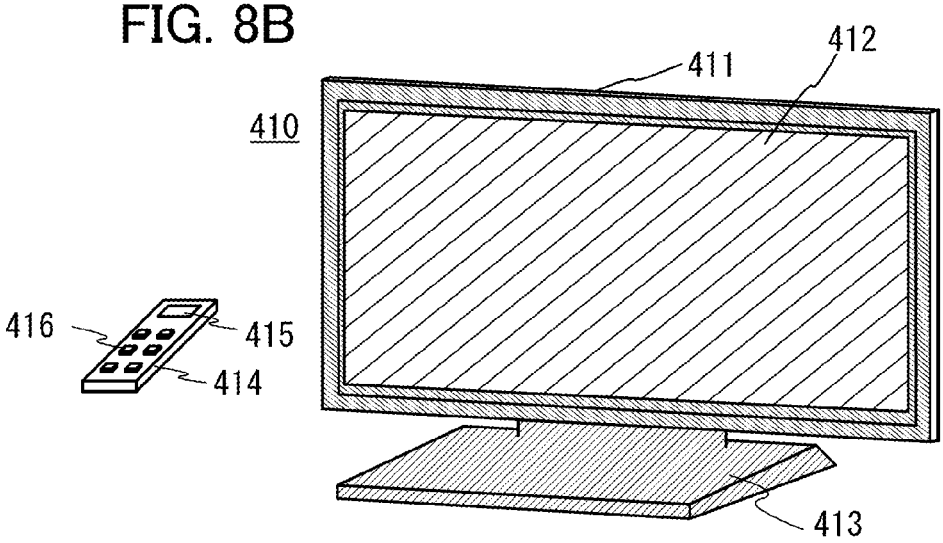

FIG. 8B illustrates a television set 410. In the television set 410, a display portion 412 is incorporated in a housing 411. The display device manufactured according one embodiment of the present invention can be used in the display portion 412, so that an image can be displayed on the display portion 412. Note that the housing 411 is supported by a stand 413 here.

The television set 410 can be operated with an operation switch provided in the housing 411 or a separate remote controller 414. Channels can be switched and volume can be controlled with operation keys 416 of the remote control 414, whereby an image displayed on the display portion 412 can be controlled. Furthermore, the remote controller 414 may be provided with a display portion 415 for displaying information output from the remote controller 414.

The television set 410 illustrated in FIG. 8B is provided with a receiver, a modem, and the like. In the television set 410, general TV broadcasts can be received with the receiver. Moreover, when the television set 410 is connected to a communication network with or without wires via the modem, one-way (from a sender to a receiver) or two-way (e.g., between a sender and a receiver or between receivers) information communication can be performed.

When a display device described in the above embodiment is used in the display portion 412 of the television set, the television set can have a higher display quality than the conventional one.

Figure 8C:
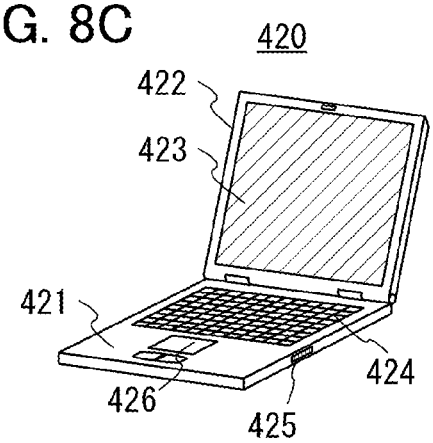

FIG. 8C illustrates a personal computer 420 including a housing 421, a housing 422, a display portion 423, a keyboard 424, an external connection port 425, a pointing device 426, and the like. The computer is manufactured using a display device manufactured according to one embodiment of the present invention in the display portion 423.

When a display device described in the above embodiment is used in the display portion 423 of the computer, the display portion of the computer can have a higher display quality than the conventional one.

Figure 8D:
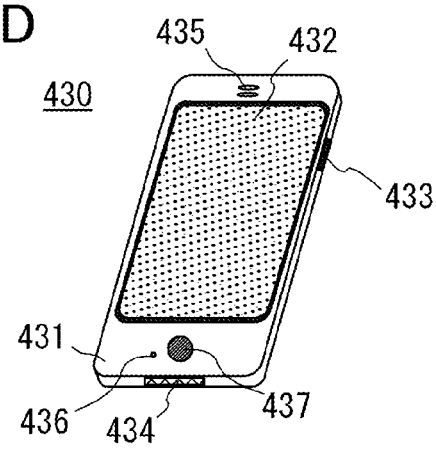

FIG. 8D illustrates an example of a mobile phone. A mobile phone 430 includes a display portion 432 incorporated in a housing 431, a power button 433, an external connection port 434, a speaker 435, a microphone 436, an operation button 437, and the like. The mobile phone 430 is manufactured using a display device manufactured according to one embodiment of the present invention in the display portion 432.

Users can input data, make a call, or text a message by touching the display portion 432 of the mobile phone 430 illustrated in FIG. 8D with their fingers or the like.

There are mainly three screen modes for the display portion 432. The first mode is a display mode mainly for displaying images. The second mode is an input mode mainly for inputting data such as text. The third mode is the one in which two modes of the display mode and the input mode are combined.

For example, in the case of making a call or text messaging, an input mode mainly for inputting text is selected for the display portion 432 so that characters displayed on a screen can be input. In that case, it is preferable to display a keyboard or number buttons on almost all the area of the screen of the display portion 432.

By providing a detection device which includes a sensor for detecting inclination, such as a gyroscope or an acceleration sensor, inside the mobile phone 430, the direction of the mobile phone 430 (whether the mobile phone 430 is placed horizontally or vertically for a landscape mode or a portrait mode) is determined so that display on the screen of the display portion 432 can be automatically switched.

The screen modes are switched by touching the display portion 432 or operating the operation button 437 of the housing 431. Alternatively, the screen modes can be switched depending on kinds of images displayed in the display portion 432. For example, when a signal of an image displayed on the display portion is a signal of moving image data, the screen mode is switched to the display mode; when the signal is a signal of text data, the screen mode is switched to the input mode.

In addition, in the input mode, when input by touching the display portion 432 is not performed within a specified period while a signal detected by an optical sensor in the display portion 432 is detected, the screen mode may be controlled so as to be switched from the input mode to the display mode.

Further, the display portion 432 can also function as an image sensor. For example, an image of a palm print, a fingerprint, or the like is taken by touching the display portion 432 with the palm or the finger, whereby personal identification can be performed. Further, by providing a backlight or a sensing light source which emits a near-infrared light in the display portion, an image of a finger vein, a palm vein, or the like can be taken.

When a display device described in the above embodiment is used in the display portion 432 of the mobile phone, the mobile phone can have a higher display quality than the conventional one.

The methods and structures described in this embodiment can be combined as appropriate with any of the methods and structures described in the other embodiments.

This application is based on Japanese Patent Application serial No. 2011-105909 filed with Japan Patent Office on May 11, 2011, the entire contents of which are hereby incorporated by reference.

What is claimed is:

1. A driving method for an active matrix display device comprising:

a display element;

a capacitor;

a data line;

a first gate signal line;

a second gate signal line;

a plurality of first transistors each including a gate electrode connected to the first gate signal line;

a plurality of second transistors each including a gate electrode connected to the second gate signal line; and one or more third transistors, the driving method comprising:

a first period;

a second period;

a third period; and a fourth period, wherein:

a first electrode of the third transistor is connected to a first electrode of one of the first transistors and a second electrode of one of the second transistors, a gate electrode of the third transistor is connected to a second electrode of the one of the first transistors and a first electrode of the capacitor, a second electrode of the third transistor is connected to a first electrode of the other one of the second transistors and a second electrode of the other one of the first transistors, a first electrode of the other one of the first transistors is connected to the data line, a second electrode of the other one of the second transistors is connected to a first electrode of the display element, all the first transistors and all the second transistors are on in the first period, all the first transistors are on and all the second transistors are off in the second period, all the first transistors and all the second transistors are off in the third period, and all the first transistors are off and all the second transistors are on in the fourth period.

2. The driving method for the active matrix display device according to claim 1, wherein the second period follows the first period, the third period follows the second period, the fourth period follows the third period, and the first period follows the fourth period.

3. The driving method for the active matrix display device according to claim 1, wherein a length of the first period is equal to a length of the third period.

4. The active matrix display device according to claim 1, wherein the first to third transistors are n-channel transistors.

5. The active matrix display device according to claim 1, wherein a potential of the first electrode of the third transistor is higher than a potential of a second electrode of the display element.

6. The active matrix display device according to claim 1, wherein the display element is an organic EL element.

7. A driving method for an display device comprising:

a first transistor;

a second transistor;

a third transistor whose first electrode is electrically connected to a first electrode of the second transistor;

a fourth transistor whose first electrode is electrically connected to the first electrode of the third transistor and whose gate electrode is electrically connected to a second electrode of the second transistor;

a fifth transistor whose first electrode is electrically connected to a first electrode of the first transistor and a second electrode of the fourth transistor;

a sixth transistor whose first electrode is electrically connected to a second electrode of the fifth transistor;

a capacitor whose first electrode is electrically connected to the gate electrode of the fourth transistor and whose second electrode is electrically connected to the first electrode of the sixth transistor; and a display element whose first electrode is electrically connected to the second electrode of the fifth transistor, the driving method comprising:

a first period;

a second period;

a third period; and a fourth period, wherein:

the first transistor, the second transistor, the third transistor, the fifth transistor and the sixth transistor are on in the first period, the first transistor, the second transistor and the sixth transistor are on and the third transistor and the fifth transistor are off in the second period, the first transistor, the second transistor, the third transistor, the fifth transistor and the sixth transistor are off in the third period, and the first transistor, the second transistor and the sixth transistor are off and the third transistor and the fifth transistor are on in the fourth period.

8. The driving method for the display device according to claim 7, wherein the first to sixth transistors are n-channel transistors.

9. The driving method for the display device according to claim 7, wherein the sixth transistor is a n-channel transistor, and wherein the first electrode of the display element is a positive electrode.

10. The driving method for the display device according to claim 7, wherein the display element is an organic EL element.

11. The driving method for the display device according to claim 7, wherein a gate electrode of the first transistor is electrically connected to a gate electrode of the second transistor and a gate electrode of the sixth transistor, and wherein a gate electrode of the third transistor is electrically connected to a gate electrode of the fifth transistor.

12. A driving method for an active matrix display device comprising:

a first gate signal line;

a second gate signal line;

a data line;

a first transistor;

a second transistor;

a third transistor;

a fourth transistor;

a fifth transistor;

a sixth transistor;

a capacitor; and a display element, the driving method comprising:

a first period;

a second period;

a third period; and a fourth period, wherein:

a gate electrode of the first transistor is connected to the first gate signal line a first electrode of the first transistor is connected to the data line, a second electrode of the first transistor is connected to a second electrode of the fourth transistor and a first electrode of the fifth transistor, a gate electrode of the second transistor is connected to the first gate signal line, a first electrode of the second transistor is connected to a second electrode of the third transistor and a first electrode of the fourth transistor, a second electrode of the second transistor is connected to a gate electrode of the fourth transistor and a first electrode of the capacitor, a gate electrode of the third transistor is connected to the second gate signal line, the second electrode of the fourth transistor is connected to the first electrode of the fifth transistor, a gate electrode of the fifth transistor is connected to the second gate signal line, a second electrode of the fifth transistor is connected to a first electrode of the display element, a second electrode of the capacitor, and a first electrode of the sixth transistor, a gate electrode of the sixth transistor is connected to the first gate signal line, the first transistor, the second transistor, the third transistor, the fifth transistor and the sixth transistor are on in the first period, the first transistor, the second transistor and the sixth transistor are on and the third transistor and the fifth transistor are off in the second period, the first transistor, the second transistor, the third transistor, the fifth transistor and the sixth transistor are off in the third period, and the first transistor, the second transistor and the sixth transistor are off and the third transistor and the fifth transistor are on in the fourth period.

13. The driving method for the active matrix display device according to claim 12, wherein the first to sixth transistors are n-channel transistors.

14. The driving method for the active matrix display device according to claim 12, wherein a potential of a first electrode of the third transistor is higher than a potential of a second electrode of the sixth transistor and a potential of a second electrode of the display element.

15. The driving method for the active matrix display device according to claim 12, wherein a potential of a second electrode of the sixth transistor is equal to a potential of a second electrode of the display element.

16. The driving method for the active matrix display device according to claim 12, wherein the display element is an organic EL element.

17. The display device according to claim 7, wherein the first electrode of the second transistor is directly connected to the first electrode of the fourth transistor.

18. The active matrix display device according to claim 12, wherein the first electrode of the second transistor is directly connected to the first electrode of the fourth transistor.

19. The active matrix display device according to claim 1, wherein the second electrode of the third transistor is directly connected to both of the first electrode of the other one of the second transistors and the second electrode of the other one of the first transistors.

* * * * *